US006305410B1

(12) United States Patent
Cook et al.

(10) Patent No.: US 6,305,410 B1
(45) Date of Patent: Oct. 23, 2001

(54) SEWAGE EJECTOR BASIN AND ASSEMBLY

(75) Inventors: Charles E. Cook, Byron; Randall D. Waldron, Rochester, both of NY (US)

(73) Assignee: Liberty Pumps, Bergen, NY (US)

( * ) Notice: Subject to any disclaimer, the term of this patent is extended or adjusted under 35 U.S.C. 154(b) by 0 days.

(21) Appl. No.: 09/301,043

(22) Filed: Apr. 28, 1999

(51) Int. Cl.[7] ..... F16K 24/00; E02D 29/14
(52) U.S. Cl. ..... 137/363; 137/565.17
(58) Field of Search ..... 137/363, 565.07, 137/565, 17, 565.39; 241/46.01

(56) References Cited

U.S. PATENT DOCUMENTS 3,112,760 * 12/1963 Budd ..... 137/363
4,245,664 * 1/1981 Johnson ..... 137/236.1
4,344,543 * 8/1982 Hoffman ..... 220/565
4,709,723 * 12/1987 Sidaway et al. ..... 137/584
4,822,213 * 4/1989 Grace et al. ..... 137/363 X
5,441,632 * 8/1995 Charon ..... 210/170
5,553,794 * 9/1996 Oliver et al. ..... 241/46.01 X
5,562,254 * 10/1996 Sleasman et al. ..... 241/46.01
6,059,208 * 5/2000 Struthers ..... 241/46.01

* cited by examiner

*Primary Examiner*—John Rivell
(74) *Attorney, Agent, or Firm*—Stephen B. Salai, Esq.; Brian B. Shaw, Esq.; Harter, Secrest & Emery LLP

(57) ABSTRACT

A sewage ejector system includes a basin and top cover. The basin body includes a generally cylindrical wall, a closed bottom, and an open top. Several features assist in installation, handling and/or performance of the basin. An annular collar projecting from the outer surface of the wall is useful for inhibiting flotation of the basin. Diametrically opposed recesses formed in the outer wall surface facilitate handling of the basin during transport and installation. A raised annular edge at the top of the basin body protects outer edges of the top cover.

15 Claims, 5 Drawing Sheets

SEWAGE EJECTOR BASIN AND ASSEMBLY

FIELD OF THE INVENTION

This invention relates to a sewage ejector basin for receiving and distributing sewage via a pump housed in the basin. Additionally, the invention provides a sewage ejector assembly including the basin, a top cover for the basin, and the pump housed in the basin for pumping sewage received in the basin through an outlet in the assembly.

BACKGROUND OF THE INVENTION

Generally, sewage may be distributed from a sewage source to a desired location by gravity flow or by pumping. For example, for residential sewage, all sources of sewage in the residence may be located higher than the public sewer or septic tank connection, and the sewage may be transported to the connection solely by gravity flow. However, if a sewage source is located at a lower elevation than the sewer line connection, it becomes necessary to pump sewage to the connection. One example is a bathroom installation in a basement where the sewer line connection is located higher than the toilet.

Sewage ejector assemblies may be installed to distribute sewage from a source to the desired sewer line connection. These assemblies typically include a container having an inlet, where sewage is received from the sewage source, and a pump for pumping received sewage to an outlet of the container, the outlet for connection to a sewer line leading to the public sewer or septic tank. For example, Liberty Pumps (Bergen, N.Y. USA) markets pre-assembled sewage ejectors under the trade name "370-Series" that comprise a polyethylene basin with an inlet nub (referred to in the industry as a "hub") adapted to be connected to a sewage source, a cover for the top of the basin, a pump mounted in the basin, and an outlet pipe extending from the pump to outside the cover. Such basins are rotationally molded in a two-part mold having a part-line parallel to the basin bottom that dissects the body inlet nub. The various components also may be sold individually for custom assembly at a job site. The basin may be installed immediately beneath the foundation, for example, such that the top of the basin is flush with the foundation slab, or located underground beyond the foundation and backfilled with soil. In either case, the inlet to the ejector system is in connection with the sewage source, and the outlet is in connection with a line running to the public sewer, a septic tank or alternate sewage treatment device.

SUMMARY OF THE INVENTION

This invention provides an improved fluid ejector assembly and basin therefor.

According to certain embodiments of the invention, there is provided a basin for receiving sewage and housing a pump therein, comprising: a basin body comprising a generally cylindrical wall including an inner wall surface and an outer wall surface, and a closed bottom at a bottom portion of the cylindrical wall, the cylindrical wall terminating at a top portion of the basin body to define an open top; and an annular collar projecting from the outer wall surface at a bottom portion thereof, wherein the basin body and annular collar are integrally molded from a resin. The annular collar inhibits flotation of the basin, for example, where the basin is installed in a hole subject to rising groundwater. This annular collar may project from the outer wall surface adjacent the closed bottom.

According to other embodiments, this invention relates to a basin for a sewage ejector system that comprises the basin body having diametrically opposed recesses formed in the outer wall surface near a top portion thereof. The recesses facilitate handling of the basin during transport and installation.

The invention also relates to a sewage ejector assembly comprising the basin for receiving sewage comprising a basin body, the basin body comprising a generally cylindrical wall including an inner wall surface and an outer wall surface, integral annular ribs projecting from the outer wall surface, and an integral closed bottom at a bottom portion of the cylindrical wall, where the cylindrical wall terminates at a top portion of the basin body to define an open top, a top portion of the generally cylindrical wall including a flat annular region. The assembly also comprises a top cover for covering the open top of the basin, an outer lower edge surface of the top cover being sealingly engageable with the flat annular region of the basin, the basin body further comprising a raised annular edge circumferentially surrounding the flat annular region and outer edges of the top cover when engaged with the basin body. The raised annular edge and the basin body may be integrally molded from a resin. The raised annular edge may have an outer surface with a diameter corresponding to a diameter of the outer wall surface at the top portion of the basin body, and an inner surface with a diameter greater than an outer diameter of the top cover. This raised annular edge has a height sufficient to inhibit mortar or concrete applied about the basin during installation from interfering with the seal between the basin and top cover. Preferably, the raised annular edge has a height at least one-half the thickness of the top cover.

According to other embodiments, the inlet opening of the basin may be formed in a nub projecting from the outer wall surface of the basin body, the inlet for connection to a sewage source line. An outlet opening may be formed in the top cover, through which a pipe extends, one end of pipe connected to pump in the basin interior and the other end adapted for connection to a conduit running to the sewer line.

DETAILED DESCRIPTION OF THE PREFERRED EMBODIMENT

Figure 1:
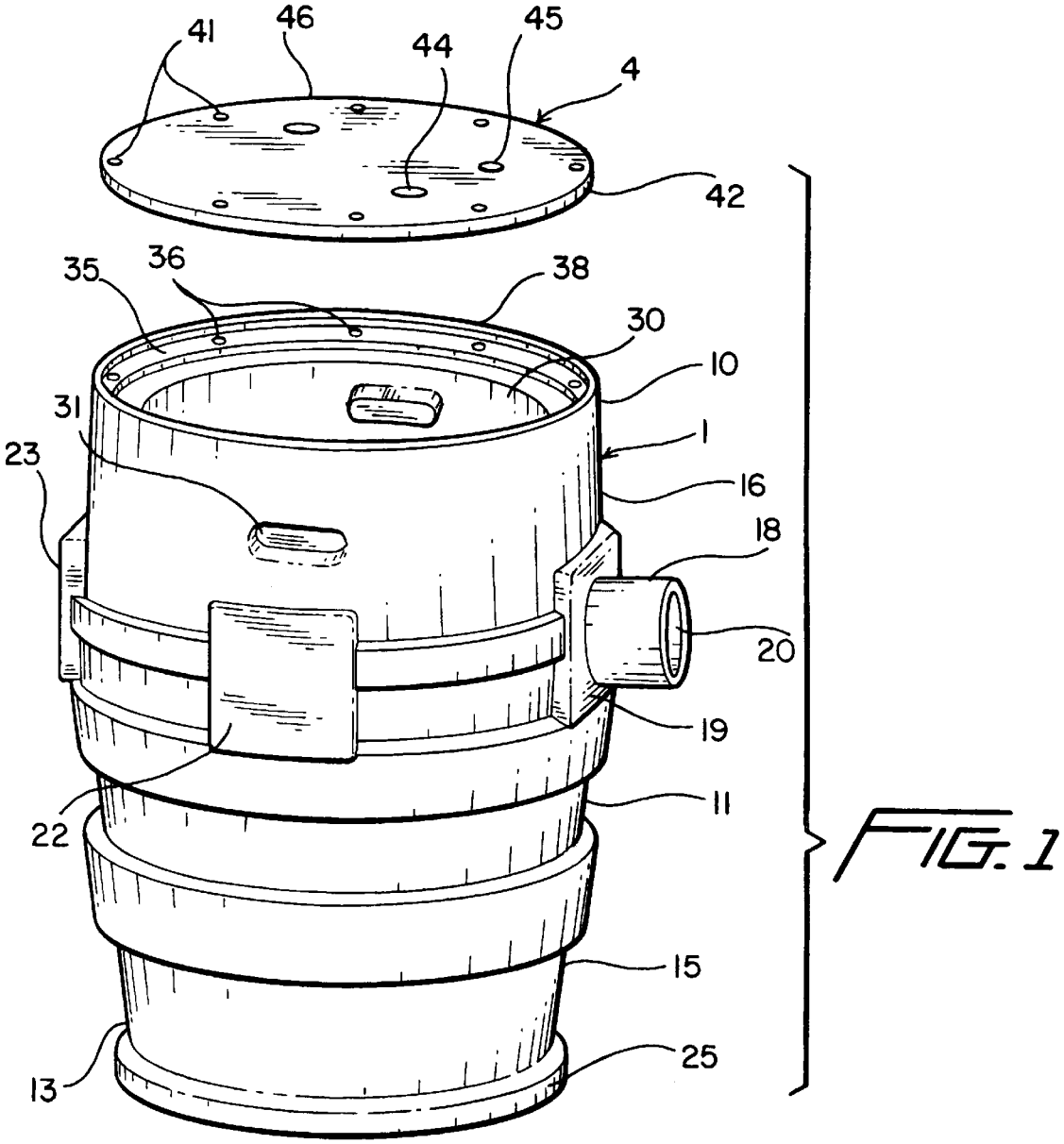
FIG. 1 is an exploded perspective view of a sewage ejector basin and top cover according to various embodiments of the invention.
Figure 2:
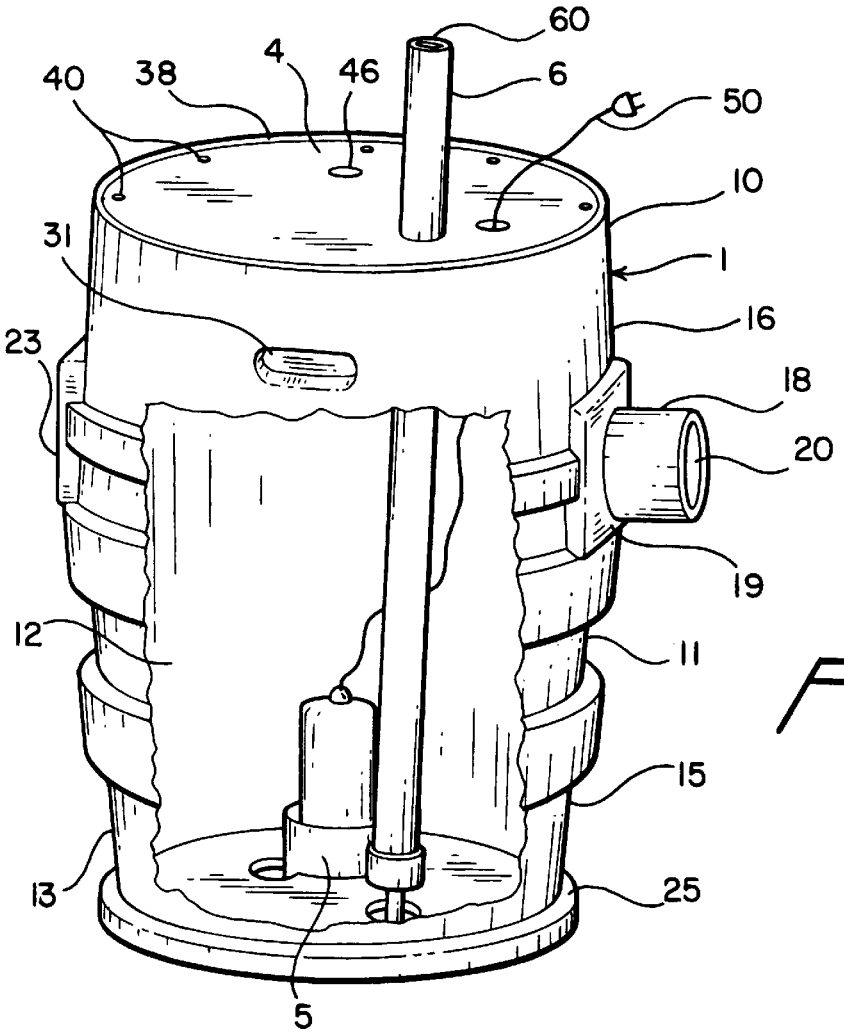
FIG. 2 is a cut-away perspective view of a sewage ejector assembly.

FIGS. 1 and 2 illustrate a sewage ejector assembly according to various embodiments of the invention. The assembly includes basin 1, top cover 4, and pump 5 mounted in the basin.

Basin 1, further illustrated in FIGS. 3–8, is composed of basin body 10 comprised of generally cylindrical wall 11, defined by inner wall surface 12 and outer wall surface 13, and bottom 14 at the bottom portion of wall 11. The term "generally cylindrical" denotes that wall 11 may have a shape deviating from a cylinder, for example, wall 11 may include one or more sections having a frustoconical shape. For the embodiment illustrated in the figures, wall 11 includes a lower section 15 having a downwardly tapered frustoconical shape, and an upper section 16 having an upwardly tapered frustoconical shape.

Basin 1 is adapted to receive sewage from a sewage source. As used herein, the term "sewage" denotes liquid and/or solid waste typically carried off in sewers or drains, or typically transported to a sewer or septic tank, including effluent of partially treated sewage. It is noted however, although the illustrated and described embodiment is especially adapted for applications involving distribution of sewage, it is understood that these embodiments may be employed to distribute liquids such as groundwater if desired.

Nub 18 extends from flat 19 located on the outer wall surface 13 at the juncture of lower section 15 and upper section 16 of wall 11. Nub 18 has the general form of a cylindrical shell and is adapted for connection to a sewage source conduit, for example, a drainage line from a residential bathroom. Nub 18 may have an outside diameter of about 4.3 to about 4.5 inches, and an inside diameter of about 4 inches, for connection with standard 4-inch polyvinyl chloride (PVC) conduit drainage line. Nub 18 may extend from flat 19 about 2.5 to about 3 inches, especially about 2.875 inches, to ensure adequate connection with the line from the sewage source. It is understood, however, that nub 18 may have various sizes and shapes as desired for making connection to a sewage source. Accordingly, the opening 20 within nub 18 serves as an inlet to basin 1.

In the illustrated embodiment, outer wall surface 13 includes additional flats 22, 23, 24 at the juncture of lower section 15 and upper section 16. Depending on a particular installation, it may be desired to form additional inlets to the basin, and one may cut an opening in one or more of flats 22, 23, 24 for such purposes.

According to certain embodiments of this invention, basin body 10 is preferably molded from a resin, such as polyethylene, polypropylene, or polyester. The molded body should have sufficient structural integrity that the basin may be inserted in an installation hole and backfilled with soil and/or concrete. A benefit of a plastic resin is that such materials are lighter in weight and less prone to rusting or deterioration than metallic materials, thus providing easier installation and longer service life. The basin body 10 may be formed from the resin by various methods, such as injection molding or rotational molding, or hand or machine lay-up.

Preferably, the entire basin body 10, for example, the basin body illustrated in FIGS. 3–8, is an integral, one-piece molding. A preferred method involves rotational molding, where a molten resin is charged to a mold, and the mold is omnidirectionally rotated in a manner that the molten coating evenly coats the inside of the mold. Upon cooling, the resin solidifies to form a molded body of uniform thickness resin, and the mold parts are separated to recover the molded body. More specifically, the mold comprises two main mold parts having molding surfaces shaped to form the generally cylindrical wall outer surfaces of the basin, including such structure as nub 18, collar 25 and ribs 27, 28, 29 with a part-line along a longitudinal axis of the basin, specifically, along line A—A shown in FIG. 6. Such a longitudinal part-line permits rotational molding of the basin body illustrated in FIGS. 3–8 without encountering problems in recovering the molded body from the mold. Regarding nub 18, this projection may be initially molded with a longer length, with the extra length removed by cutting to expose opening 20. Supplemental mold parts may be provided to form a top and bottom surface of the molded body, the bottom including such structure as raised annuluses 21. Additionally, the molded body may initially include a closed top, with the open top of the basin being cut from the molded body.

An annular collar 25 is located at the bottom of wall 11, more specifically, collar 25 projects from the entire circumference of outer wall surface 13 at the bottom thereof. Collar 25 serves to inhibit flotation of the basin 1 after installation. More specifically, the hole in which the basin is installed may be subject to rising groundwater, which in some cases results in the basin having a tendency to float. In such circumstances, collar 25 prevents flotation of the basin.

Annular collar 25 may have thickness of about 0.25 to about 1.5 inches, preferably about 1 inch, and may project from outer wall surface 13 about 1 to 2 inches, preferably about 1 inch.

Outer wall surface 13 may include a plurality of annular projections or ribs 27, 28, 29 on outer wall surface 13 above annular collar 25. In other words, projections 27, 28, 29 project from outer wall surface 13 around the circumference thereof. These annular projections 27, 28, 29 provide the basin body with increased hoop strength and better structural integrity. It has been found that projections 27, 28, 29 may provide better structural integrity than longitudinal projections in prior molded sewage ejector basins, especially when the basin is installed in heavy clay soils or other wet soils and subjected to hydraulic pressure. The annular projections are preferably located mainly at the lower section 15 of the basin body, since this section is subjected to more pressure from surrounding soil. Projections 27, 28, 29 may further reduce the tendency of the basin to float in wet soil as for collar 25.

The top section 16 of basin body 10 may include diametrically opposed recesses 31, 32 in the outer wall surface 13. Recesses 31, 32 serve as handles to facilitate transport of the basin and handling of the basin during installation. Recesses 31, 32 preferably have a depth of at least 1.5 inches, preferably about 2 inches, a length of at least 3 inches, preferably about 3.5 to about 4.5 inches, and a height of at least 1 inch, preferably about 1.25 to about 1.5 inches, to ensure sufficient gripping area and space for an installer's fingers. Wall 11 may have a thickness, between the outer and inner wall surfaces, varying between about 0.125 to about 0.25 inches, preferably about 0.15 inches, along the height of the basin. Accordingly, recesses 31, 32 may extend beyond inner wall surface 12, if necessary to provide sufficient gripping area. It is noted that recesses 31, 32 should not have the form of openings extending between the outer and inner wall surface 13, 12, as many applications will dictate that the basin is essentially sealed from the external environment upon final installation.

The basin may have various overall sizes and shapes. For example, for various residential and light industrial sewage applications, basin body may have an overall height of about 30 inches and an inside diameter at the bottom of the basin of about 18 inches, basins based on these dimensions being conventional in the US. An advantage of lower section 15 of the basin body having the downwardly tapered shape is that volume capacity is increased while maintaining the bottom diameter at 18 inches.

According to various embodiments of this invention, the basin body includes raised annular edge 38 that circumferentially surrounds region 35, as well as the top cover outer edge 42 when the top cover is in place. As illustrated in the figures, raised annular edge is an extension of outer wall surface l3 at the top of the basin body 10. Preferably, raised annular edge 38 has a height at least half the thickness of the top cover at its outer edges, that is, edge 38 projects from region 35 by at least half the thickness of the top cover. Edge 38 may have a height that approximates the thickness of the top cover. In some applications, the basin may be installed in a building foundation, for example, prior to a basement floor slab being poured or after a hole has been made in the existing slab; it may be desired that the top of the installed basin is accessible for future maintenance, and often it is desired that the top is flush or nearly flush with the top slab surface. In such installations, after making the inlet connection to the basin, the hole may be partially backfilled and then the slab is poured around the basin top, or the hole in the existing slab is patched with mortar around the basin top. Annular edge 38 at the top of the basin serves to prohibit mortar or concrete from being placed on region 35 (in the case where the cover has not yet been secured to the basin body), or to prohibit mortar or concrete from being placed on the juncture of the top cover and basin body (in the case where the top cover is secured to the basin body prior to pouring the slab or patching with mortar).

Top cover 4 is adapted to cover the top opening 30 in basin body. The lower annular edge surface of the top cover rests on flat annular region 35 at the top of wall 11 and circumferentially surrounds opening 30. Top cover 4 may be secured to annular region 35 with fasteners, such as bolts 40 received in recessed, threaded inserts 36 in region 35 and corresponding holes 41 in the top cover 4. For certain applications, it is preferred that an essentially fluid tight seal is formed between the top cover and the basin. For this purpose, a gasket may be included between annular region 35 and the lower annular edge surface of the top cover that contacts region 35. The seal should be sufficient to inhibit fluids in the environment outside the basin, such as groundwater, from entering the basin interior, and to inhibit fluids, such as sewer gases, from escaping from the interior of the basin. Top cover 4 may be formed of various materials, including metals such as steel or a plastic resin, such as polyethylene, polypropylene, or polyester. The top cover generally will be formed separately from the molding of the basin.

As mentioned, the basin serves as a reservoir for sewage received from a source through inlet 20 and to distribute the sewage to a sewer line, such as a public sewer or septic tank. Accordingly, the basin includes an outlet. In the illustrated embodiments, top cover 4 includes an opening 44 through which pipe 6 extends. One end of pipe 6 is connected to pump 5 in the interior of the basin, and the other end 60, external to the basin interior, is adapted for connection to a conduit running to the sewer line. As an example, pipe 6 may be a 2-inch pipe, or other sizes as desired. Pump 5 may be an electrical sump pump, such as the type including a float actuator, in which case top cover 4 includes an opening 45 through which the pump electrical cord or cords 50 extend. Additionally, the top cover may include opening 46 for mounting of a vent line for controlled venting of sewer gases and maintaining ambient pressure in the basin interior.

Figure 9:
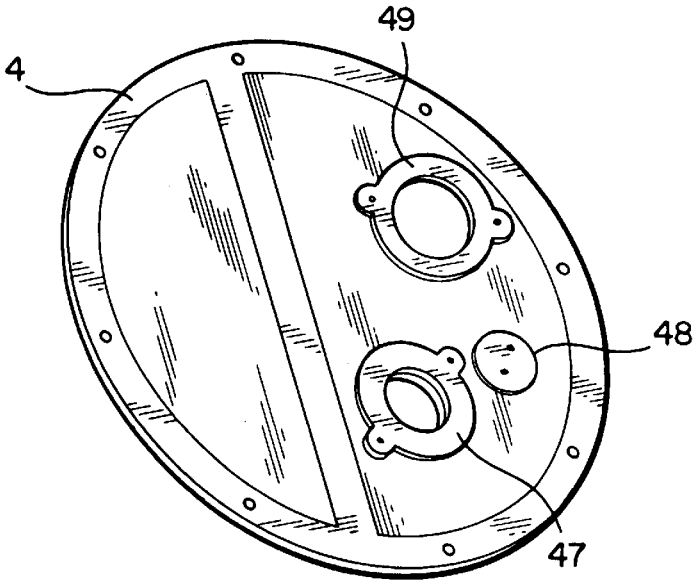
FIG. 9 is a top perspective view of a top cover for the basin assembly of this invention.
Figure 3:
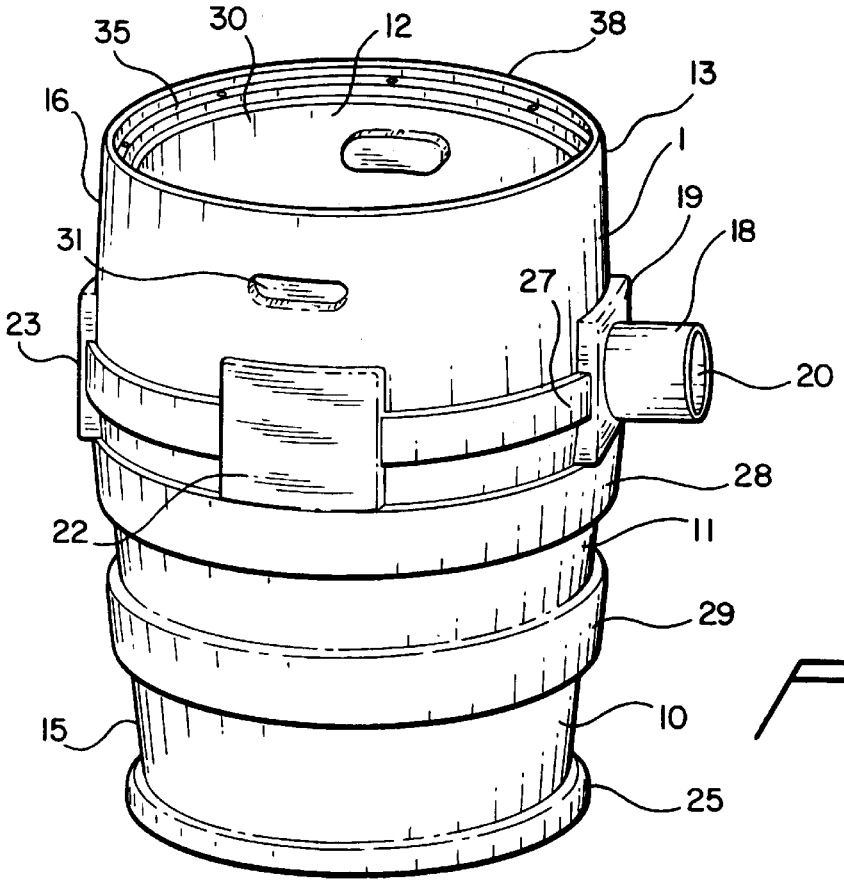
FIG. 3 is a perspective view of a sewage ejector basin as shown in FIGS. 1 and 2.
Figure 6:
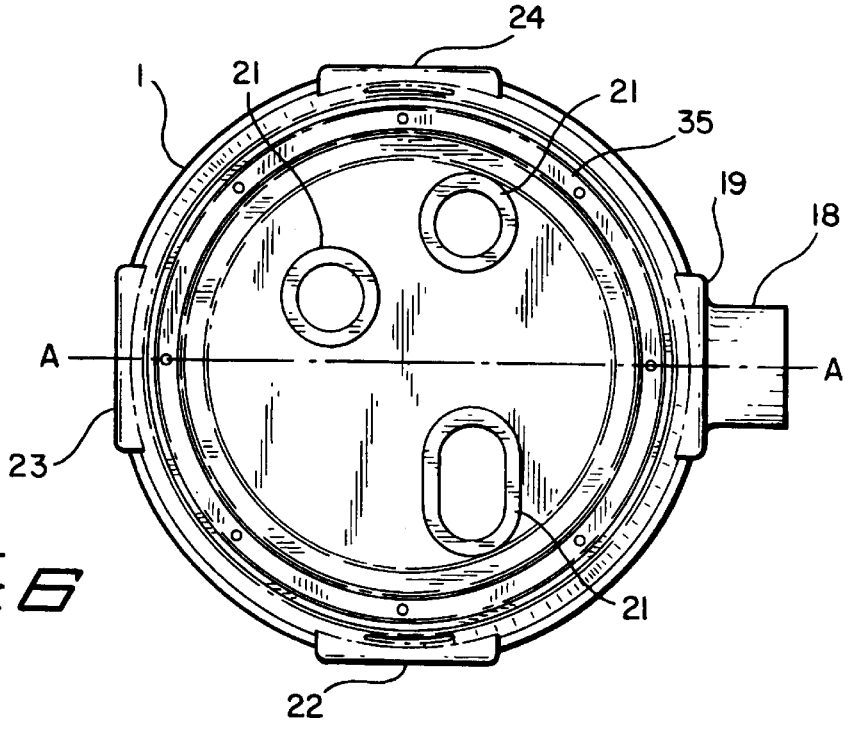
FIG. 6 is a top plan view of the basin shown in FIG. 3.
Figure 4:
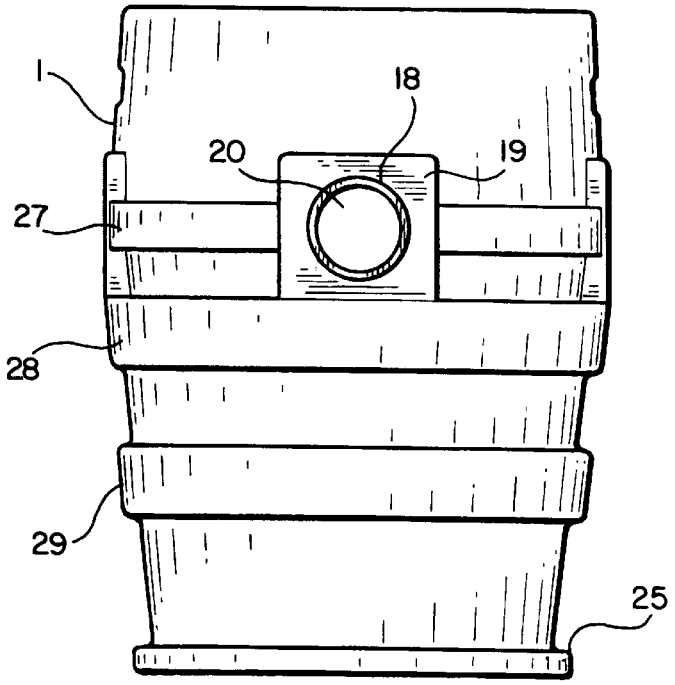
FIG. 4 is a front plan view of a sewage ejector basin shown in FIG. 3.
Figure 5:
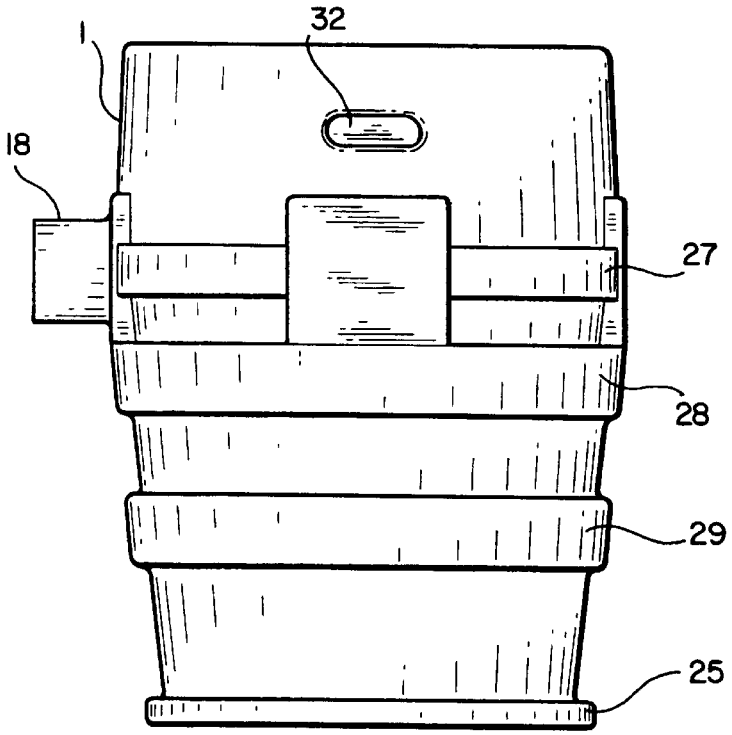
FIG. 5 is a side plan view of the basin shown in FIG. 3.
Figure 7:
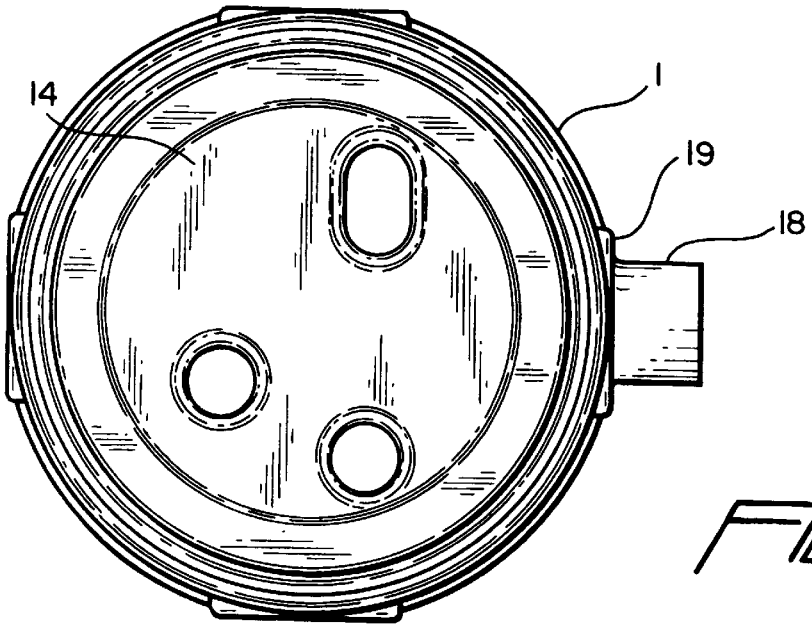
FIG. 7 is a bottom plan view of the basin shown in FIG. 3.
Figure 8:
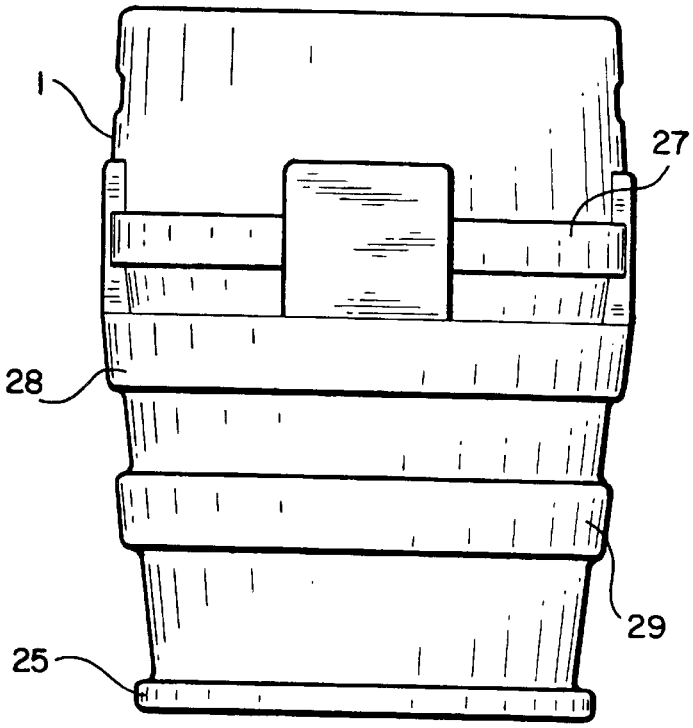
FIG. 8 is a back plan view of the basin shown in FIG. 3.

Any pipes or cords extending through openings in the top cover, such as openings 44, 45 and 46, are preferably sealed about the corresponding opening. FIG. 9 illustrates a specific embodiment of a top cover for the basin assembly of this invention. According to this illustrated embodiment, opening 44 is surrounded by a flange 47 with a resilient seal that forms a seal about the periphery of an outlet pipe inserted therethrough. Opening 45 has a resilient gasket 48 inserted therein, gasket 48 shown in FIG. 9 adapted to accommodate two electrical cords. Opening 46 is surrounded by a threaded flange 49 for threaded engagement with a vent pipe.

In the illustrated embodiment, the bottom 14 includes several raised annuluses 21, these annuluses projecting upwardly from the interior of bottom 14. The raised annuluses may be integral with the basin bottom, for example, formed during molding of the basin. The raised annuluses serve as stabilizing pockets for the pump received in the basin. In other words, legs or projections on the pump bottom nest against the various annuluses so as to stabilize the pump and inhibit rotation of the pump. Raised annuluses may be raised from the interior of bottom 14 by about 0.5 to 2 inches, preferably about 1 inch.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. A basin for receiving sewage and housing a pump therein, comprising:

a one-piece, molded basin body comprising: a generally cylindrical wall including an inner wall surface and an outer wall surface;

a closed bottom at a bottom portion of the cylindrical wall, the cylindrical wall terminating at a top portion of the basin body to define an open top; and an annular collar projecting from the outer wall surface at a bottom portion thereof;

further comprising diametrically opposed recesses formed in the outer wall surface near a top portion thereof, the recesses facilitating handling of the basin during transport and installation.

2. A basin for receiving sewage and housing a pump therein, comprising:

a one-piece basin body comprising: a generally cylindrical wall including an inner wall surface and an outer wall surface, and an integral closed bottom at a bottom portion of the cylindrical wall, the cylindrical wall terminating at a top portion of the basin body to define an open top;

wherein diametrically opposed recesses are formed in the outer wall surface near a top portion thereof, the recesses facilitating handling of the basin during transport and installation.

3. The basin of claim 2, wherein the recesses project inwardly from the outer wall surface by at least 1.5 inches.

4. The basin of claim 2, wherein the generally cylindrical wall includes an inlet opening.

5. The basin of claim 4, wherein the inlet opening is formed in an integral nub projecting from the outer surface of the generally cylindrical wall for connection to a sewage source line.

6. The basin of claim 5, wherein the nub projects from a flat in the generally cylindrical wall outer surface.

7. The basin of claim 2, wherein the basin body comprises integral annular ribs projecting from the outer wall surface.

8. The basin of claim 2, wherein a lower section of the generally cylindrical wall is downwardly tapered.

9. The basin of claim 8, wherein an upper section of the generally cylindrical wall is upwardly tapered.

10. A sewage ejector assembly comprising:

a one-piece, molded basin for receiving sewage comprising a basin body, the basin body comprising a generally cylindrical wall including an inner wall surface and an outer wall surface and including annular ribs projecting from the outer wall surface, and an integral closed bottom at a bottom portion of the cylindrical wall, the cylindrical wall terminating at a top portion of the basin body to define an open top, a top portion of the generally cylindrical wall including a flat annular region the basin body; and a top cover for covering the open top of the basin, an outer lower edge surface of the top cover being sealingly engageable with the first annular region of the basin, the basin body further comprising a raised annular edge circumferentially surrounding the flat annular region and outer edges of the edge of the top cover when engaged with the basin body;

wherein the top cover includes an outlet opening therein.

11. The assembly of claim 10, further comprising an outlet pipe for connection to a sewer line, the outlet pipe extending from a pump mounted in an interior of the basin and through the outlet opening in the top cover.

12. The assembly of claim 10, wherein the generally cylindrical wall includes an inlet opening.

13. The assembly of claim 12, wherein the inlet opening is formed in a nub projecting from the outer surface of the generally cylindrical wall for connection to a sewage source line.

14. The assembly of claim 13, wherein the nub projects from a flat in the generally cylindrical wall outer surface.

15. A sewage ejector assembly comprising:

a one-piece, molded basin for receiving sewage comprising a basin body, the basin body comprising a generally cylindrical wall including an inner wall surface and an outer wall surface and including annular ribs projecting from the outer wall surface, and an integral closed bottom at a bottom portion of the cylindrical wall, the cylindrical wall terminating at a top portion of the basin body to define an open top, a top potion of the generally cylindrical wall including a flat annular region the basin body; and a top cover for covering the top of the basin, an outer lower edge surface of the top cover being sealingly engageable with the first annular region of the basin, the basin body further comprising a raised annular edge circumferentially surrounding the flat annular region and outer edges of the edge of the top cover when engaged with the basin body;

wherein an integral annular collar projects from the outer wall surface at a bottom portion thereof adjacent the closed bottom, and diametrically opposed recesses are formed in the outer wall neaar the top portion thereof, the recesses facilitating handling of the basin during transport and installation.

* * * * *

US006305410C1

(12) EX PARTE REEXAMINATION CERTIFICATE (6765th)

United States Patent

Cook et al.

(10) Number: US 6,305,410 C1

(45) Certificate Issued: Apr. 14, 2009

(54) SEWAGE EJECTOR BASIN AND ASSEMBLY

(75) Inventors: Charles E. Cook, Byron, NY (US); Randall D. Waldron, Rochester, NY (US)

(73) Assignee: Liberty Pumps, Bergen, NY (US)

Reexamination Request:
No. 90/006,922, Jan. 27, 2004

Reexamination Certificate for:

| | |
|---|---|
| Patent No.: | **6,305,410** |
| Issued: | **Oct. 23, 2001** |
| Appl. No.: | **09/301,043** |
| Filed: | **Apr. 28, 1999** |

(51) Int. Cl.

| | |
|---|---|
| ***E03F 5/00*** | (2006.01) |
| ***E03F 5/22*** | (2006.01) |
| ***E03F 11/00*** | (2006.01) |
| ***F16K 24/00*** | (2006.01) |
| ***E02D 29/14*** | (2006.01) |

(52) U.S. Cl. ..... 137/363; 137/565.17

(58) Field of Classification Search ..... 137/363, 137/565.07, 565, 17; 241/46.01; 210/532.2; 220/770, 771

See application file for complete search history.

(56) References Cited

U.S. PATENT DOCUMENTS

| | | | | | |
|---|---|---|---|---|---|
| 3,097,166 | A | * | 7/1963 | Monson | 210/532.2 |
| 3,112,760 | A | * | 12/1963 | Budd | 137/363 |
| 3,207,359 | A | * | 9/1965 | Heisler et al. | 220/771 |
| 3,361,290 | A | * | 1/1968 | Matthews et al. | 220/771 |
| D243,766 | S | * | 3/1977 | Isaacs | D23/203 |
| 4,245,664 | A | * | 1/1981 | Johnson | 137/236.1 |
| 4,344,543 | A | | 8/1982 | Hoffman | |
| 4,663,036 | A | * | 5/1987 | Strobl et al. | 210/532.2 |
| 4,709,723 | A | | 12/1987 | Sidaway et al. | |
| 4,822,213 | A | * | 4/1989 | Grace et al. | 137/363 |
| 4,832,227 | A | | 5/1989 | Hoffman | |
| 5,441,632 | A | * | 8/1995 | Charon | 210/170 |
| 5,553,794 | A | * | 9/1996 | Oliver et al. | 241/46.01 |
| 5,562,254 | A | | 10/1996 | Sleasman et al. | |
| 5,806,702 | A | | 9/1998 | Sabo | |
| 6,059,208 | A | * | 5/2000 | Struthers | 241/46.01 |
| 6,305,410 | B1 | | 10/2001 | Cook et al. | |

OTHER PUBLICATIONS

Hancor Waste Management Product Catalog, p. 65 entitled "Waste Water Accessories", no date given.*

Topp Industries, Inc. Catalog, page entitled "Tapered Corrugated Sump Basins. 18×30" & 18×24"", no date given.*

AK Industries, Inc. Catalog, pp. 18 and and 22, no date given.*

Little Giant Pump Co. Brochure, page entitled "QTI Package System,"no date given.*

1994 Liberty Pumps, Inc. brochure, pp. 8, 370, 4550, 700 and 750 simplex systems show prior art basins with outlets in their respective top covers.

370–Series brochure by Liberty Pumps, Inc.

* cited by examiner

*Primary Examiner*—Sara S Clarke

(57) ABSTRACT

A sewage ejector system includes a basin and top cover. The basin body includes a generally cylindrical wall, a closed bottom, and an open top. Several features assist in installation, handling and/or performance of the basin. An annular collar projecting from the outer surface of the wall is useful for inhibiting flotation of the basin. Diametrically opposed recesses formed in the outer wall surface facilitate handling of the basin during transport and installation. A raised annular edge at the top of the basin body protects outer edges of the top cover.

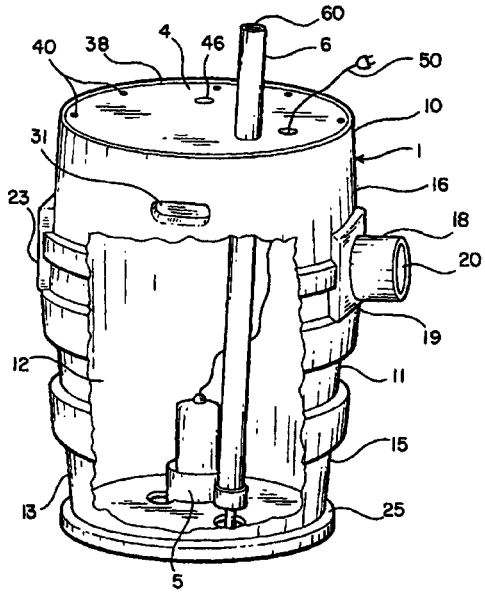

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–15 are cancelled.

* * * * *